US008800507B2

(12) United States Patent
Trease

(10) Patent No.: US 8,800,507 B2
(45) Date of Patent: Aug. 12, 2014

(54) INTERLOCKING PISTON BARRELS IN A V-TWIN MOTORCYCLE ENGINE

(76) Inventor: John M. Trease, Melbourne (AU)

( * ) Notice: Subject to any disclaimer, the term of this patent is extended or adjusted under 35 U.S.C. 154(b) by 292 days.

(21) Appl. No.: 13/447,705

(22) Filed: Apr. 16, 2012

(65) Prior Publication Data

US 2012/0260881 A1 Oct. 18, 2012

Related U.S. Application Data

(60) Provisional application No. 61/476,375, filed on Apr. 18, 2011.

(51) Int. Cl.
*F02B 75/22* (2006.01)

(52) U.S. Cl.
USPC ..... 123/54.4; 123/193.2

(58) Field of Classification Search
USPC ..... 123/54.4, 193.2
See application file for complete search history.

(56) References Cited

U.S. PATENT DOCUMENTS

| | | | | |
|---|---|---|---|---|
| 5,341,781 | A * | 8/1994 | Gerhardt | 123/195 R |
| 6,152,097 | A * | 11/2000 | Sputhe | 123/195 R |
| 2005/0229877 | A1 * | 10/2005 | Botelho et al. | 123/54.4 |
| 2009/0205591 | A1 * | 8/2009 | Shand | 123/54.4 |
| 2010/0242870 | A1 * | 9/2010 | Terada et al. | 123/54.4 |

* cited by examiner

*Primary Examiner* — Marguerite McMahon
(74) *Attorney, Agent, or Firm* — Welsh Flaxman & Gitler LLC

(57) ABSTRACT

A cylinder head assembly in which the two cylinders of a V-twin configuration are arranged in a V with the cylinder provided on a plane which is transverse to the crankshaft of an internal combustion engine and normal thereto. Each of the cylinders is assembled together with an interlocking interference fit for installation on a common crankcase to permit larger engine displacements within the given physical dimensional space of the engine.

9 Claims, 6 Drawing Sheets

INTERLOCKING PISTON BARRELS IN A V-TWIN MOTORCYCLE ENGINE

CROSS REFERENCE TO RELATED APPLICATIONS

This application claims the benefit of U.S. Provisional Patent Application Ser. No. 61/476,375 filed Apr. 18, 2011, entitled, "INTERLOCKING PISTON BARRELS IN A V-TWIN MOTORCYCLE ENGINE".

BACKGROUND OF THE INVENTION

Reciprocating piston type engines comprising twin cylinders arranged in a V configuration are the main type of internal combustion engines presently used for highway class motorcycles, generally known as V-twin engines. Each of these V-twin engines contains the same common major internal components having a fixed geometric relationship to each other, consisting of a rotating assembly containing a flywheel and at least one crankpin. Additionally, a piston or ring set would be used in a reciprocating assembly. These two types of assemblies are joined together by a connecting rod with a piston pin at one end and a crankpin at the other end. Due to small physical limitations available within the engine compartment of most motorcycle frames, a designer to improve performance is usually constrained in the selection of optimal cylinder bore size and stroke lengths of the connecting rods. Furthermore, the overall engine height is determined by the sum of the resulting crank case deck height and cylinder length, which in turn defines a connecting rod length for a given engine bore/stroke selection. Usually, it is desirable to minimize engine height to gain advantages by providing a lower center of gravity for handling purposes and also to provide a lower seat height to aid in the comfort of the operator, as well as any passengers.

A second design limitation is due to the proper piston selection for a given engine bore/stroke design. At the lowest point of the connecting rod stroke, the piston is at the bottom of the cylinder. It is known that for greater engine reliability, it is advantageous that the piston skirt i.e. the length of the piston head, be as long as possible to allow for greater wearing surface between the exterior of the piston skirt and the interior of the cylinder bore. It is also advantageous for the piston skirt to protrude below the crankcase deck height, providing for greater engine rigidity and less torque loading on the cylinder fasteners. However, the length of the piston skirt should be small enough to prevent contacting the flywheels at the bottom of the stroke without increasing the crankcase deck height or the connecting rod length, which would in turn also compromise the engine height.

One of the most common configurations of an air-cooled V-twin design is to mount two cylinders on the same crankcase, generally with one cylinder in front of the second cylinder. This design has the advantage of a very narrow engine that is not as high as the resulting configuration if the same displacement were achieved with only a single cylinder. Additionally, most V-twin type engines are mounted lengthwise within the motorcycle frame, thereby providing the narrowest engine width possible for the operator straddling the engine compartment.

Since modern highway travel allows the motorcycle to travel at higher speeds regardless of the inclusion of additional weight applied to the motorcycle, for example, luggage as well as a passenger, there is an ongoing quest for greater general performance. This quest has resulted in significant increases to V-twin motorcycle engine displacements with the corresponding growth to either bore, stroke or bulk dimensions. Previously, engine displacements were limited not only by physical space limitations on the motorcycle, but also by the reliability and overheating particularly on air-cooled engines. Recent advances in engineering design methods and materials as well as lubricants have, for the most part, mitigated the issues of reliability on larger displacement engines.

However, these newer larger displacement engines still face physical size and space challenges. To increase displacement, either the cylinder bores must increase in volume, or the stroke lengths of the connecting rods must become larger. In the case of increasing the stroke length to achieve more displacement, the engine must inevitably be taller. If this was not the case, dimensional changes would then conflict with intake port (manifold or throttle body) and exhaust part (pipes or headers) alignment and fit. In the case of a bore volume increase beyond that permitted by a typical cylinder wall thickness, crankcases would occasionally need to be overbored as well or be cast larger resulting in end material thickness and integrity problems. Repositioning larger holes in the crankcase to accept larger bore sizes would result in possible fastener size and location changes or weakening the crankcase structural integrity.

With respect to a V-twin engine, these decisions could also impact the selection of the cylinder angle with respect to the crankcase. Larger cylinder bores would have to be sufficiently spaced apart from one another and could not always be accommodated by merely over-boring the existing cylinders. When larger cylinders are attempted to be placed on the existing crankcase, the cylinder angle generally must be increased to fit the larger displacement cylinders. This problem is compounded by the fact that larger cylinders generally create larger thermal loads and would thereby require larger cooling fins. The utilization of these larger cooling fins would compound the problem even further by compromising the cylinder angle.

A further result of the employment of larger bores and the resulting increased cylinder angle is the noticeable change in engine exhaust acoustics. Utilizing different cylinder angles would necessitate changing the firing intervals within each piston barrel (crank phasing), thereby producing different engine noises than the motorcycle enthusiast has come to expect.

Attempts to increase displacement on air-cooled V-twin motorcycle engines have been accomplished by lengthening the connecting rod stroke and increasing deck height by adding individual cylinder spacer plates, a single crankcase "wedge-type" spacer block or by shortening piston skirts to the point of very low service life and reliability. Other attempts to increase displacement were to build into the crankcase design a taller crankcase with a cast-in increased deck height. Each of these aforementioned attempts is a compromise to either engine reliability or engine height. In every circumstance, there is also a physical limitation to increasing the bore size without having to increase the cylinder angle or compromising the crankcase integrity.

U.S. Pat. No. 6,357,401 to Moriyama et al., U.S. Pat. No. 6,382,169 to Gausman, U.S. Pat. No. 7,174,874 to Liang et al, U.S. Pat. No. 7,703,423 to Burgess et al. and U.S. Pat. No. 7,444,979 to Dondlinger et al. recite typical V-twin engines having one cylinder angled with respect to the second cylinder. As illustrated in these patents, each of the cylinders is independent of one another as, for example, as shown in FIG. 4 of the Gausman reference.

U.S. Patent Application Publication No. 2009/0205591 to Shand illustrates a twin V engine in which the lower portion of the cylinders contact each other as shown in FIGS. 2 and 6.

The lower cylindrical skirts of each of the pistons are formed with cutout portions, preventing the pistons from touching each other when they are at the bottom of their stroke as shown in FIG. 6. However, this reference does not adequately address the problem of the prior art relating to motorcycle performance.

SUMMARY OF THE INVENTION

The present invention overcomes the deficiencies of the prior teachings by providing increased flexibility in selecting the maximal size of the cylinder bore/stroke configuration for the air-cooled V-twin motorcycle engine by interlocking the two cylinders together at the critical junction point located at the base of the cylinders. This particular configuration would allow the piston skirt to be elongated without increasing the height of the engine. This would also allow a larger bore size of each of the cylinders to be utilized, such as up to five inches in diameter.

The cylinder bores would be manufactured with matched corresponding machined-in design features near the bottom of the cylinder bore flanges. One of the cylinders, preferably the rear cylinder would have a slot machined into its lower base flange which would be inserted into a notch created in the lower base flange of the second cylinder, preferably the front cylinder, thereby allowing larger cylinder sizes to be employed. These intersecting larger bore sizes would not normally be possible when the cylinders are adjacent to one another without a higher crankcase deck height or an increase in the cylinder angle which would affect the performance of the engine. Appropriately manufactured pistons along with final machine joint surfaces and cylinder wall wearing surface coatings would permit the use of larger bore sizes and stroke lengths, without the necessity of increasing the cylinder angle which would in turn increase the engine length and alter the engine sound. The stroke length can be lengthened, according to the present invention to be between seven inches and nine inches. Alternatively, the deck height would be increased which would in turn increase the engine height. The present invention would provide each of the interlocking cylinders with an asymmetrical larger cooling fin design that increases flow area without significant changes to visual aesthetics or dimensional compromise to the engine compartment space availability.

The utilization of the interlocking cylinder design would allow the cylinders to fit into a smaller volumetric space than is utilized in the prior art V-twin configuration.

Additionally, larger engine displacements are possible through increased stroke length of the connecting rod without proportional increases to the crankcase deck height, thereby minimizing overall engine height.

The increase in the cylinder bore size utilizing the interlocking cylinders of the present invention would result in increased torque (more power at lower RPM) and lower piston speed. As can be appreciated, the lower piston speed would increase the engine life when compared to the prior art V-twin configuration. Furthermore, the greater bore sizes of the cylinders of the present invention would permit higher compression ratios resulting in greater horsepower. Additionally, the present invention would produce a wider squish band between the top of the cylinder bore and the top of the piston and its top deck center position based upon the increased stroke length of the connecting rod attached to the piston. This would allow the utilization of larger valves at the head of the cylinder which control the influx of air and fuel from the carburetor as well as the efflux of the combusted mixture.

Furthermore, the pistons provided in each of the cylinders could be fitted with longer skirt lengths, thereby increasing the contact area at the bottom of the stroke and reducing wearing surface stresses on the inside surface of each of the cylinders, thereby increasing engine longevity. This would also reduce the possibility of the piston to "tip" or "side load" from reduced contact area when the connecting rod attached to the piston is at maximum angularity.

The present invention would allow the cylinder barrels to be provided with a longer base spigot flange which protrudes deeper into the crankcase, allowing the pistons to travel deeper below the crankcase deck level, thereby reducing torque stresses at the cylinder to barrel joint and on the cylinder to crankcase fasteners. The piston pin boss area which is the strongest part of the piston assembly is able to fully travel down to the crankcase deck surface, thereby insuring that the engine assembly is a more integral unit.

Finally, the cooling fins provided on the exterior of each of the cylinders would exhibit an asymmetric design to maximize the cooling areas required to adequately reduce thermal stresses caused by unequal heating of the cooling fins from the top of the cylinder head to the bottom of the crankcase.

Other advantages of the present invention will become readily apparent to those skilled in the art from the following detailed description and by way of illustration of the best mode contemplated of carrying out the invention. The present invention is capable of other and different embodiments and several details of modification in various respects without departing from the scope of the invention.

DESCRIPTION OF THE PREFERRED EMBODIMENT

Figure 1:
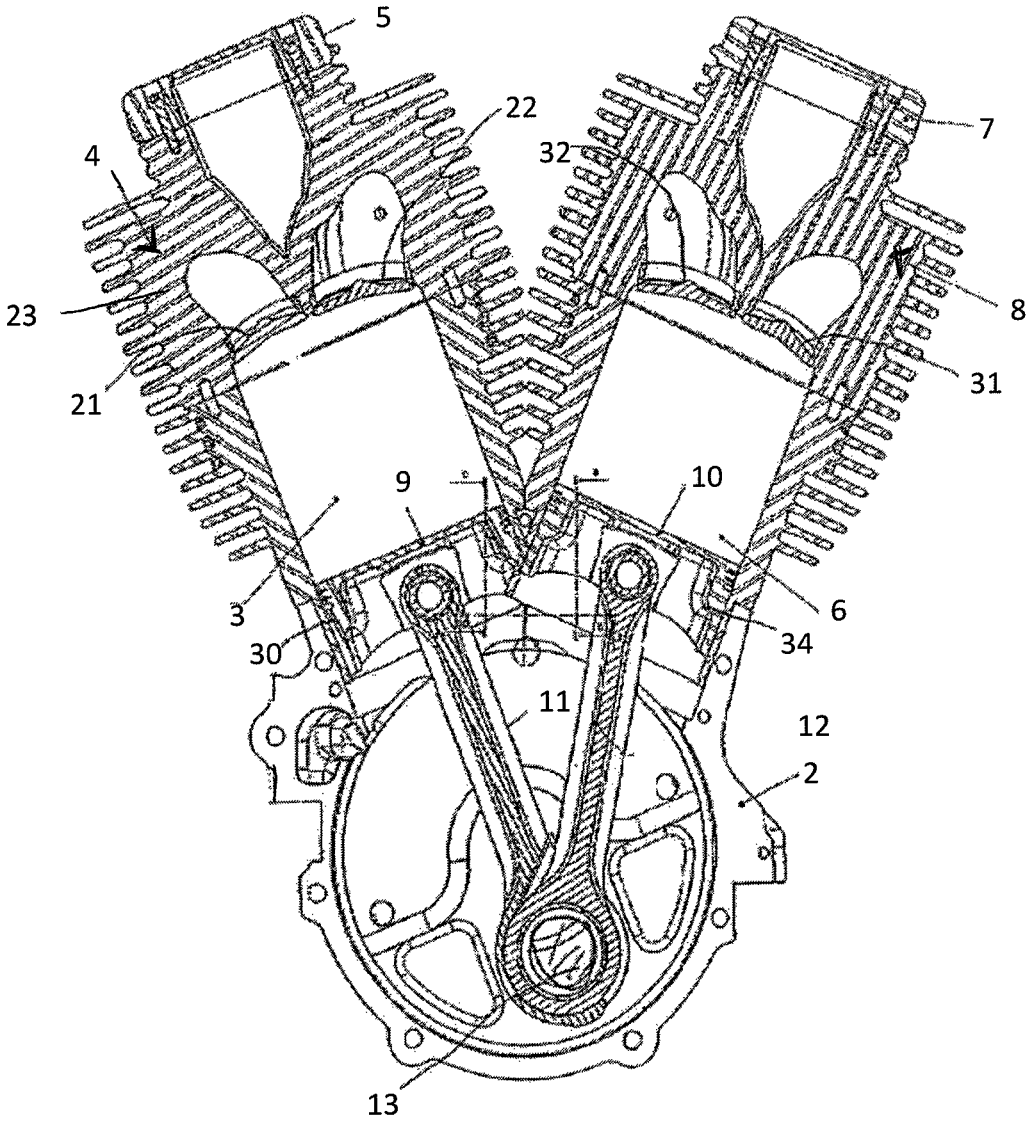
FIG. 1 is a cross-sectional view taken along line A-A in FIG. 2 showing the V-twin configuration in situ.
Figure 2:
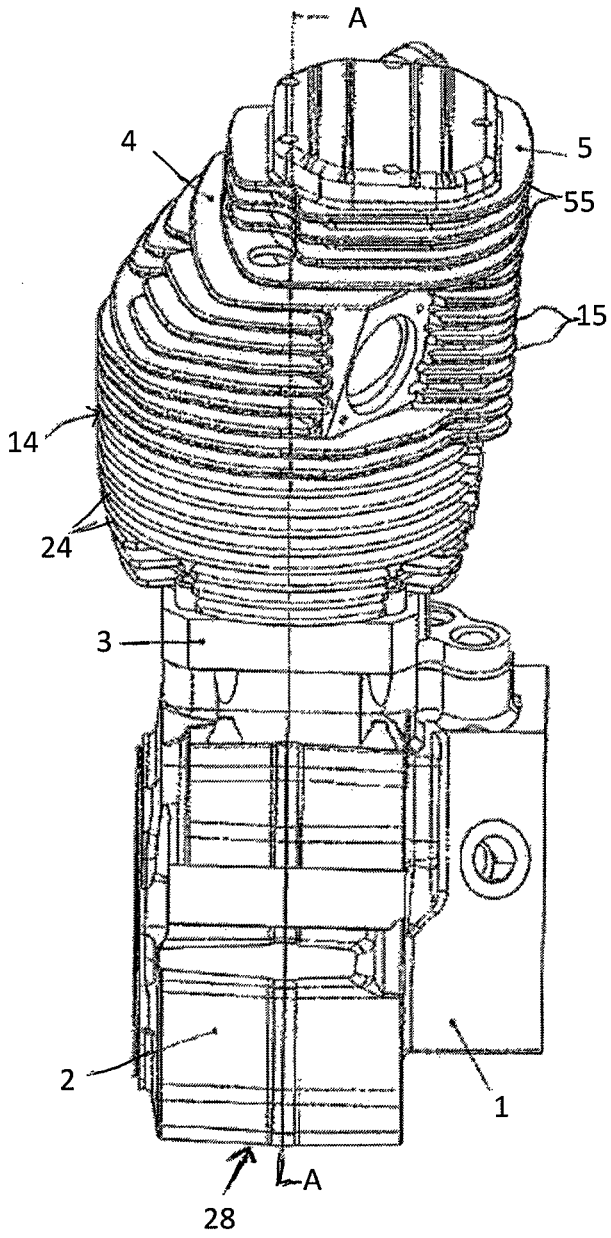
FIG. 2 is a rear view of the V-twin configuration.

The present invention as shown particularly with respect to FIGS. 1 and 2 illustrates an internal combustion engine including a rear cylinder head assembly 4 as well as a forward cylinder head assembly 8 in situ. The rear cylinder assembly 4 provided with a rear rocker cover 5, also includes a rear piston barrel 3 as well as an air/fuel mixture influx valve 21 and efflux valve 22 section 23 provided on top of the rear piston barrel 3. The valves 21, 22 are actuated by the movement of a camshaft (not shown) provided within the rear cylinder head assembly 4. This camshaft is driven by a mechanical connection to a crankshaft 13. The camshaft, via push rods actuates the opening and closing of the influx valve 21 to allow an air/fuel mixture to be introduced into the interior of the rear piston barrel 3 and opening and closing of efflux valve 22 to eliminate the combusted material. Similarly, the top of the forward piston barrel 6 is provided with an influx valve 31 as well as an efflux valve 32, forming valve section 33, which open and close in a manner similar to the operation of the valves provided on top of the rear piston barrel 3.

The rear piston barrel 3 is provided with a rear piston 9 having a skirt 30 which moves up and down in the rear piston barrel 3 by the upward and downward movement of a connecting rod 11. The movement of the connecting rod 11 is effectuated by the movement of a crankshaft 13.

The forward cylinder head assembly 8 is provided with a forward rocker cover 7, valve section 33 and a forward piston barrel 6. The forward piston barrel 6 is provided with a piston 10 having a skirt 34 which moves up and down within the forward piston barrel 6. The upward and downward movement of the forward piston 10 is effectuated by its connection to a connecting rod 12 which is also connected to the crankshaft 13. Each of the pistons 9 and 10 would travel within its respective piston barrel bores while maintaining adequate cylindrical surface contact between the interior surface of the cylinder barrel bores and the side exterior surfaces of each of the pistons.

As shown in FIG. 2, the rear cylinder head assembly 4 is provided with a cooling device 14 consisting of a plurality of cooling fins 15. It can be appreciated that the forward cylinder head assembly 8 is provided with a similar configuration of the cooling fins 15. As shown in FIG. 2, the size and shape of the cooling fins 55 in proximity with the rear rocker cover 5 is smaller than the size and shape of the cooling fins 24 provided at the bottom of the rear cylinder head assembly 4 or barrel 3. It is noted that a similar configuration of cooling fins is provided with respect to the forward cylinder head assembly 8.

Figure 3:
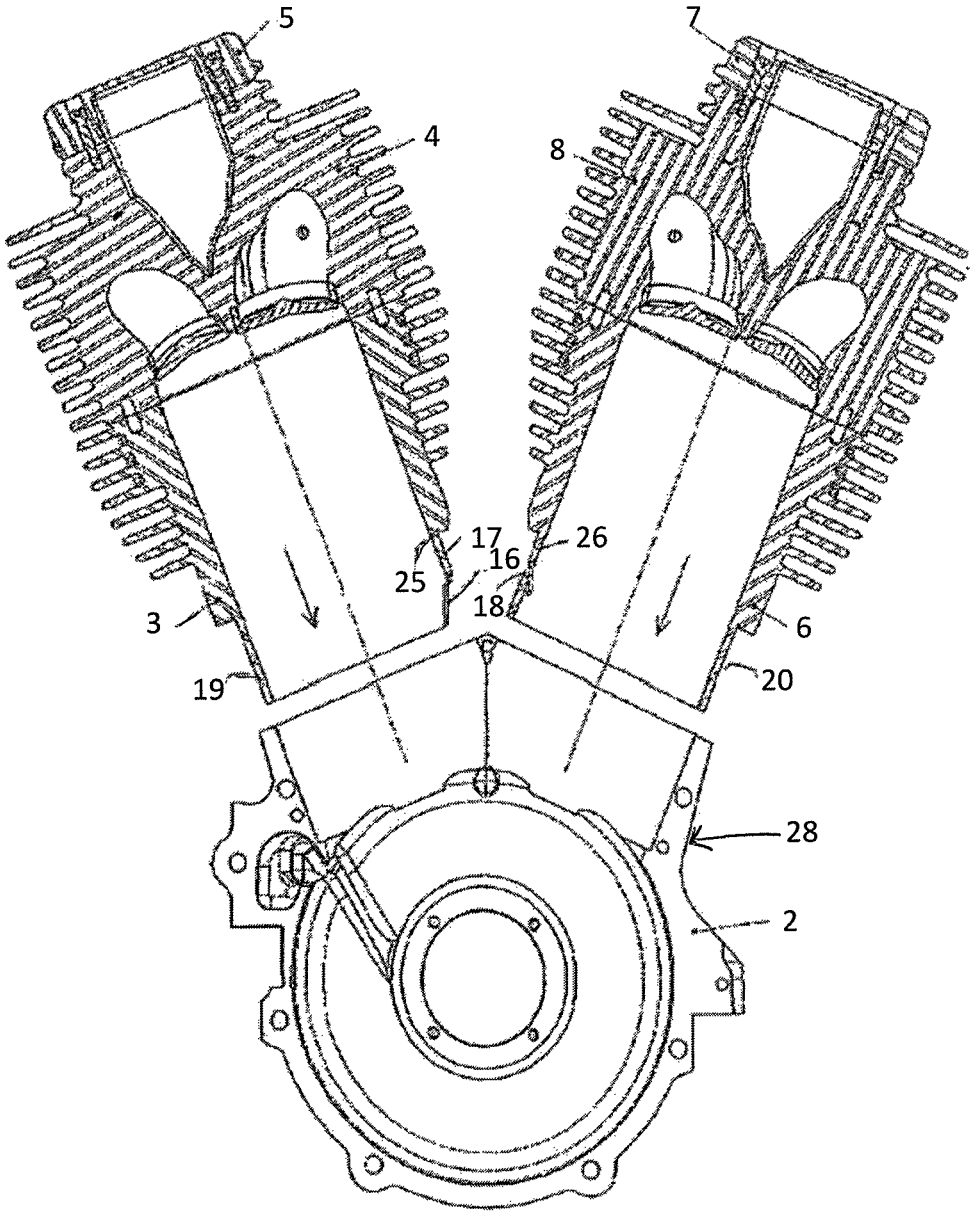
FIG. 3 is an exploded cross-sectional view of the piston barrels outside of the crankcase.

FIG. 3 illustrates the rear piston barrel 3 and the forward piston barrel 6 outside of the crankcase 28 formed by right half crankcase 1 mating and connecting to left half crankcase 2 and prior to the rear cylinder head assembly 4 and forward cylinder head assembly 8 being interlocked together. The interlocking of the two cylinder head assemblies is accomplished by modifying the flange portion 19 of the rear piston barrel 3. This modification includes changing the orientation of the bottom portion 16 of the interior surface 25 of the rear piston barrel 3. The portion 16 must be angled inwardly to form an arched opening 29 shown in FIG. 9 to allow connection of the rear piston barrel 3 to the forward piston barrel 6. The interconnection of the two piston barrels is accomplished utilizing a projection 17 formed in the arched opening 29 on the surface 25 of flange portion 19 of the rear piston barrel 3 and an arcuate aperture or slot 18, best shown in FIG. 8, provided on the surface 26 of flange portion 20 of the forward piston barrel 6.

Figure 4:
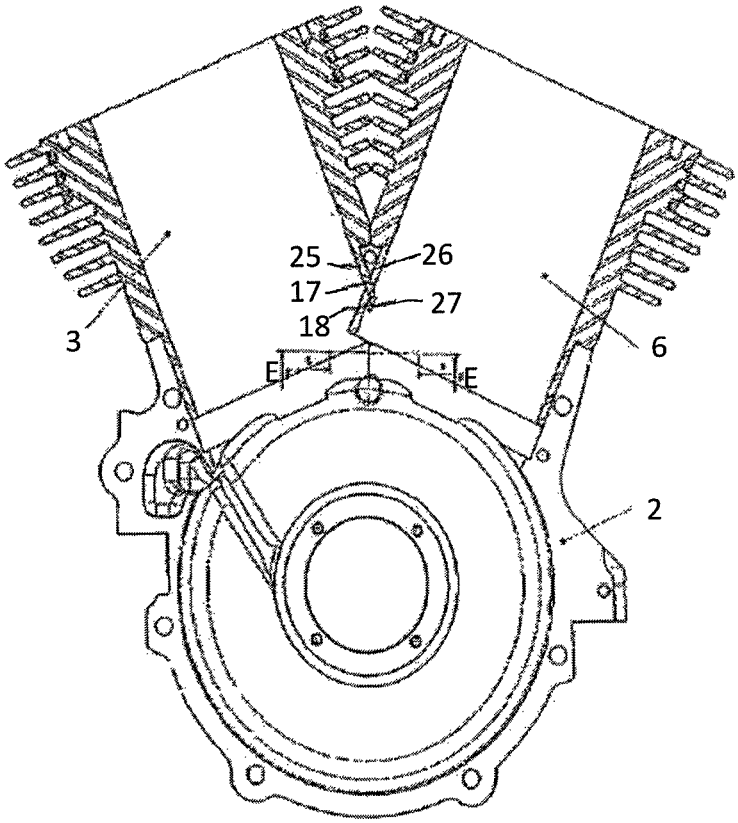
FIG. 4 is a cross-sectional view showing the piston barrels locked together.
Figure 5:
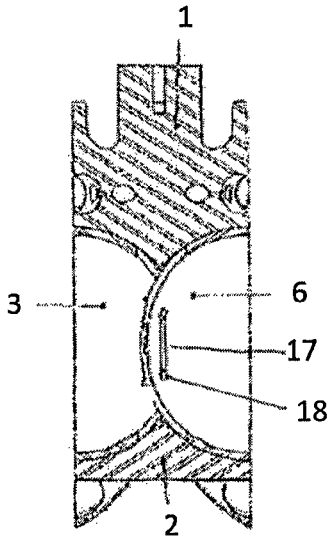
FIG. 5 is a partial bottom view showing the piston barrels locked together taken along line E-E in FIG. 4.
Figure 6:
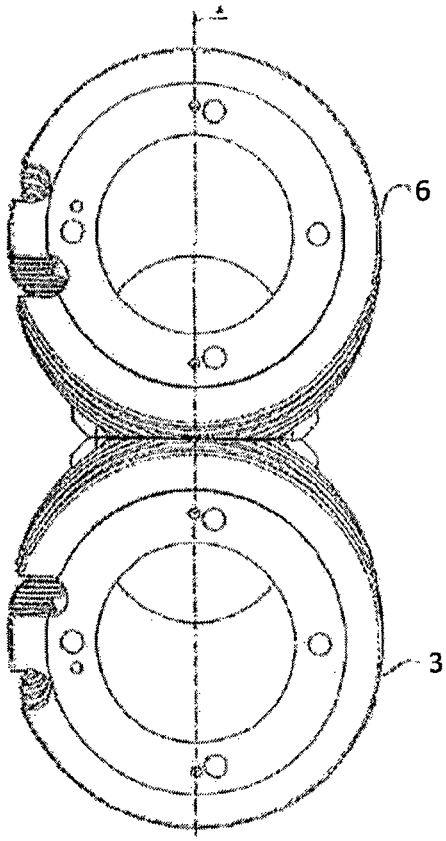
FIG. 6 is a top view of the piston barrels locked together.
Figure 7:
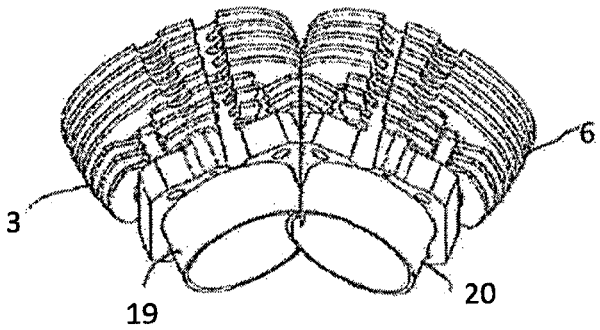
FIG. 7 is a perspective view of the barrels locked together.

FIGS. 4 and 5 show the manner in which the front and rear piston barrels are interconnected. As shown in FIG. 4, the projection 17 is inserted into the aperture or slot 18 provided on the inner surface 26 of the forward piston barrel 6. These piston barrels are secured in place by moving an end portion 27 from the projection 17 to be situated along the edge of the surface 26 of the forward piston barrel to secure the piston barrels together. FIGS. 6 and 7 additionally illustrate the manner in which the two piston barrels are attached to one another.

Figure 8:
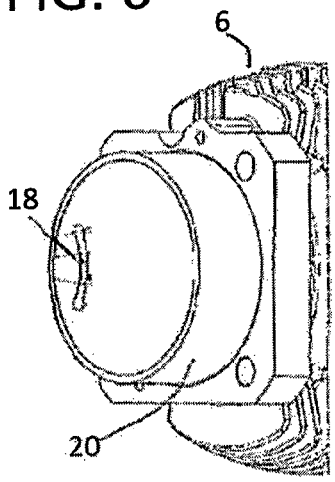
FIG. 8 is a bottom end view of the forward piston barrel.

FIG. 8 shows a view of the forward piston barrel 6 prior to this barrel being inserted into the crankcase, with slot 18 being shown in flange 20.

Figure 9:
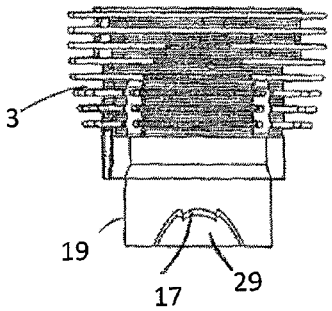
FIG. 9 is a front view of the rear piston barrel.
Figure 10:
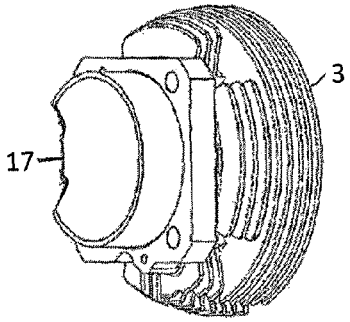
FIG. 10 is a right view of the rear piston barrel rotated 90° from that shown in FIG. 9.
Figure 11:
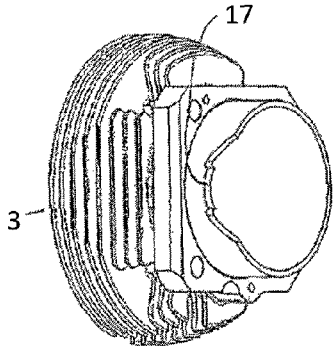
FIG. 11 is a left view of the rear piston barrel rotated 90° from that shown in FIG. 9.

FIGS. 9, 10 and 11 illustrate various views of the rear piston barrel 3 prior to it being inserted into the crankcase.

The forward piston barrel 6 is placed into the crankcase before the rear piston barrel is placed therein. Once in place, the projection 17 is inserted into the slot 18 of the forward piston barrel 6. Once the forward and rear cylinder head assemblies are in place, other fastening devices such as bolts can be used to positively attach the head assemblies to the crankcase.

The present invention being thus described, it will be obvious that it can be varied in many ways. These variations are not to be regarded as a departure from the spirit and scope of the invention. All such of these modifications are to be considered as part of the present invention.

The invention claimed is:

1. Interlocking piston barrels for a V-twin engine comprising:

a rear piston barrel with a flange portion having a bottom portion angled inwardly to form an arched opening to allow interconnection of the rear piston barrel to a forward piston barrel;

a forward piston barrel with a flange portion including an aperture in the flange portion of the forward piston barrel; wherein the flange portion of the rear piston barrel connects to the flange portion of the forward piston barrel via the arched opening mating with the flange portion of the forward piston barrel.

2. The interlocking piston barrels for a V-twin engine of claim 1, wherein a projection is formed in the bottom portion of the flange of the rear piston barrel in the arched opening and the projection is inserted into the aperture provided in the flange portion of the forward piston barrel when the arched opening mates with the flange portion of the forward piston barrel.

3. The interlocking piston barrels for a V-twin engine of claim 1, the aperture is an arcuate slot.

4. The interlocking piston barrels for a V-twin engine of claim 3, wherein a projection is formed in the bottom portion of the flange of the rear piston barrel in the arched opening and the projection is inserted into the arcuate slot provided in the flange portion of the forward piston barrel when the arched opening mates with the flange portion of the forward piston barrel.

5. The interlocking piston barrels for a V-twin engine of claim 4, wherein the arcuate slot is angled inwardly.

6. The interlocking piston barrels for a V-twin engine of claim 1 wherein, the flange portion of both the rear and front piston barrels is cylindrical.

7. The cylinder head assembly for a V-twin motorcycle engine comprising:

a rear cylinder head assembly including a rocker cover, a valve section and a piston barrel with a flange portion having a bottom portion angled inwardly to form an arched opening to allow interconnection of the rear piston barrel to a forward piston barrel;

a forward cylinder head assembly including a rocker cover, a valve section and a piston barrel with a flange portion including an aperture in the flange portion of the forward piston barrel; wherein the flange portion of the rear piston barrel connects to the flange portion of the forward piston barrel via the arched opening mating with the flange portion of the forward piston barrel.

8. The cylinder head assembly for a V-twin motorcycle engine of claim 7, wherein the front and rear piston barrels are secured to a crankcase.

9. The cylinder head assembly for a V-twin motorcycle engine of claim 7, wherein the rocker covers, the valve sections and the piston barrels all include cooling fins.

* * * * *